US010473040B2

(12) United States Patent
Miyashita

(10) Patent No.: US 10,473,040 B2
(45) Date of Patent: Nov. 12, 2019

(54) CONTROL APPARATUS FOR INTERNAL COMBUSTION ENGINE AND CONTROL METHOD FOR INTERNAL COMBUSTION ENGINE

(71) Applicant: TOYOTA JIDOSHA KABUSHIKI KAISHA, Toyota-shi, Aichi-ken (JP)

(72) Inventor: Shigeki Miyashita, Susono (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 54 days.

(21) Appl. No.: 15/925,016

(22) Filed: Mar. 19, 2018

(65) Prior Publication Data

US 2018/0274454 A1 Sep. 27, 2018

(30) Foreign Application Priority Data

Mar. 22, 2017 (JP) ..... 2017-056069

(51) Int. Cl.

| | |
|---|---|
| ***F02D 13/00*** | (2006.01) |
| ***F02D 13/02*** | (2006.01) |
| ***F02D 41/04*** | (2006.01) |
| ***F02D 41/06*** | (2006.01) |
| ***F01L 13/00*** | (2006.01) |
| ***F02D 41/00*** | (2006.01) |
| *F02M 26/05* | (2016.01) |
| *F02M 26/06* | (2016.01) |

(52) U.S. Cl.

CPC ..... *F02D 13/0211* (2013.01); *F01L 13/0015* (2013.01); *F02D 13/0253* (2013.01); *F02D 41/008* (2013.01); *F02D 41/0055* (2013.01); *F02D 41/042* (2013.01); *F02D 41/064* (2013.01); *F02D 2013/0292* (2013.01); *F02D 2041/0012* (2013.01); *F02D 2200/0414* (2013.01); *F02M 26/05* (2016.02); *F02M 26/06* (2016.02)

(58) Field of Classification Search

CPC ..... F02D 13/0211; F02D 13/0253; F02D 41/0055; F02D 41/008; F02D 41/042; F02D 41/064; F01L 13/0015

See application file for complete search history.

(56) References Cited

U.S. PATENT DOCUMENTS

| | | | | |
|---|---|---|---|---|
| 2008/0078356 | A1 | 4/2008 | Akagawa | |
| 2014/0047833 | A1* | 2/2014 | Buckland | F02D 23/00 60/599 |

(Continued)

FOREIGN PATENT DOCUMENTS

| | | | |
|---|---|---|---|
| JP | 2002-266670 | A | 9/2002 |
| JP | 2007262956 | A | 10/2007 |
| JP | 2008-088835 | A | 4/2008 |

*Primary Examiner* — Thomas N Moulis

(74) *Attorney, Agent, or Firm* — Sughrue Mion, PLLC

(57) ABSTRACT

A control apparatus for an internal combustion engine includes an electronic control unit that is configured to perform an operation of making a lift amount of a specific valve corresponding to one of either intake ports or exhaust ports for a specific cylinder in which an amount of condensate water produced in the port or flowing into the port is larger than in the other cylinders when the engine is stopped, in a case where production of condensate water in the ports or inflow of condensate water into the ports is predicted.

11 Claims, 11 Drawing Sheets

(56) References Cited

U.S. PATENT DOCUMENTS

| | | | | |
|---|---|---|---|---|
| 2014/0352663 | A1* | 12/2014 | Glugla | F02D 41/0085 123/443 |
| 2018/0119624 | A1* | 5/2018 | Schwartz | F01N 5/02 |
| 2018/0291775 | A1* | 10/2018 | Miyashita | F01L 13/0015 |
| 2019/0048813 | A1* | 2/2019 | Dudar | B60W 10/06 |

* cited by examiner

FIG. 3

| | | INTAKE SYSTEM | | | | | EXHAUST SYSTEM |
|---|---|---|---|---|---|---|---|
| SYSTEM | | WITH EGR | | | | | – (IRRELEVANT TO SYSTEM) |
| | | SUPERCHARGING LPL (INTO WHICH EGR IS INTRODUCED FROM REGION UPSTREAM OF COMPRESSOR) | | COMMON TO LPL AND HPL | | | |
| PRODUCTION REGION | | INTERCOOLER | WALL SURFACE OF INTAKE DUCT | EGR DELIVERY PORTION | WALL SURFACE OF SURGE TANK | WALL SURFACE OF INTAKE PORT | WALL SURFACES OF EXHAUST PORT AND EXHAUST PIPE |
| OPERATING CONDITION AND EXTERNAL ENVIRON-MENTAL CONDITION | ENGINE COOLANT TEMPERATURE | – (IRRELEVANT) | INCREASE DUE TO INFLUENCE OF HEAT TRANSFER WHEN COOLANT TEMPERATURE IS LOW | ← | WHEN COOLANT TEMPERATURE IS LOW (= WALL SURFACE TEMPERATURE IS LOW) (< ABOUT 40°C) | WHEN COOLANT TEMPERATURE IS LOW (= WALL SURFACE TEMPERATURE IS LOW) (< ABOUT 40°C) | WHEN COOLANT TEMPERATURE IS LOW (< ABOUT 60°C) |
| | OUTSIDE AIR TEMPERATURE | INCREASE DUE TO FALL IN IC COOLANT TEMPERATURE WHEN TEMPERATURE IS LOW | INCREASE DUE TO AIR-COOLING EFFECT WHEN TEMPERATURE IS LOW | ← | ← | – (DECREASE WHEN TEMPERATURE IS LOW) | – (INCREASE AT LOW TEMPERATURE) |
| | HUMIDITY | INCREASE WHEN HUMIDITY IS HIGH | ← | ← | ← | ← | – REDUCED INFLUENCE |
| | SUPERCHARG-ING PRESSURE | INCREASE WHEN SUPERCHARG-ING PRESSURE IS HIGH | ← | ← | ← | ← | – (IRRELEVANT) |
| | WHETHER OR NOT EGR IS CARRIED OUT | WHEN EGR IS INTRODUCED | | | | | – (IRRELEVANT) |

CONTROL APPARATUS FOR INTERNAL COMBUSTION ENGINE AND CONTROL METHOD FOR INTERNAL COMBUSTION ENGINE

INCORPORATION BY REFERENCE

The disclosure of Japanese Patent Application No. 2017-056069 filed on Mar. 22, 2017 including the specification, drawings and abstract is incorporated herein by reference in its entirety.

BACKGROUND

1. Technical Field

The disclosure relates to a control apparatus and control method for an internal combustion engine.

2. Description of Related Art

In Japanese Patent Application Publication No. 2008-088835 (JP 2008-088835 A), there is disclosed an art for restraining a throttle from being firmly fixed through the freezing of moisture condensed around the throttle after the stop of an internal combustion engine. However, the freezing caused by condensate water is not a problem peculiar to the throttle. The condensate water that is produced after the stop of the internal combustion engine reaches an intake valve and an exhaust valve as well through ports in some cases. When these valves are halfway open, condensate water accumulates between valve faces and valve seats of the intake valve and the exhaust valve due to the effect of a surface tension of condensate water. In the case where this condensate water freezes, when the internal combustion engine is started next time, a full-closure malfunction, namely, a failure to completely close the intake valve and the exhaust valve may occur, and a misfire may occur due to an excessive amount of residual gas resulting from a shortfall in fresh air and a malfunction in exhaust emission.

SUMMARY

The disclosure provides a control apparatus and control method for an internal combustion engine that can restrain a full-closure malfunction in an intake valve or an exhaust valve from occurring through the freezing of condensate water in a gap between a valve face and valve seat of the valve after the stop of the internal combustion engine.

A first aspect of the disclosure is a control apparatus for an internal combustion engine. The internal combustion engine includes a plurality of cylinders and ports. The ports include intake ports and exhaust ports corresponding to the plurality of the cylinders respectively. The internal combustion engine is an internal combustion engine in which amounts of condensate water produced in the ports or flowing into the ports are different from one another among the cylinders due to differences in shape or arrangement of the ports or conduits leading to the ports among the plurality of the cylinders as to either the intake ports or the exhaust ports. The control apparatus includes an electronic control unit. The electronic control unit is configured to perform an operation of making a lift amount of a specific valve corresponding to one of either the intake ports or the exhaust ports for a specific cylinder when the internal combustion engine is stopped, in a case where the electronic control unit predicts that condensate water is produced in one of either the intake ports or the exhaust ports or condensate water flows into one of either the intake ports or the exhaust ports. The specific cylinder is a cylinder in which an amount of condensate water produced in one of either the corresponding intake ports or the corresponding exhaust ports or condensate water flowing into one of either the corresponding intake ports or the corresponding exhaust ports is larger than in the other ones of the plurality of the cylinders.

When the lift amount of the valve is equal to zero, namely, when the valve is completely closed, there is no gap created between a valve face and a valve seat, so no condensate water accumulates therebetween. By performing this operation for the specific valve in the specific cylinder in which the amount of condensate water is larger than in the other cylinders, a full-closure malfunction in the valve can be prevented from occurring due to the freezing of condensate water in the gap between the valve face and the valve seat in the specific cylinder. Also, in the entire internal combustion engine, the occurrence of such a full-closure malfunction can be suppressed.

It can be estimated whether or not condensate water is produced in the port or flows into the port, for example, from an operating condition and external environmental condition of the internal combustion engine. An elapsed time from the stop of the internal combustion engine may also be used as a piece of information for determining whether or not condensate water flows into the port. It should be noted, however, that a problem of the freezing of condensate water in the gap between the valve face and the valve seat does not arise when the amount of condensate water is small. Therefore, the amount of condensate water in the entire engine may be estimated as to the respective ports, and the operation of making the lift amount of the specific valve equal to zero when the engine is stopped may be performed only in the case where the estimated amount of condensate water is larger than a predetermined threshold. That is, even in the case where the production of condensate water in the port or the inflow of condensate water into the port is predicted, there is no need to perform the aforementioned operation when the estimated amount of condensate water is equal to or smaller than the threshold. Thus, the consumption of energy can be suppressed.

The cylinder regarded as the specific cylinder may be fixed in advance, or may be determined each time. For example, the amounts of condensate water in either the intake ports or the exhaust ports may be estimated individually for the cylinders, and the cylinder in which the amount of condensate water is larger than in the other cylinders may be determined as the specific cylinder. Incidentally, it is not indispensable to determine only one of the cylinders as the specific cylinder. A plurality of the cylinders may be regarded as specific cylinders. For example, the cylinders constituting the internal combustion engine may be divided into a group with a relatively large amount of condensate water and a group with a relatively small amount of condensate water, and all the cylinders belonging to the group with the relatively large amount of condensate water may be regarded as specific cylinders.

The internal combustion engine may include an exhaust gas recirculation (EGR) device that recirculates part of exhaust gas to an intake passage. The ports in which condensate water is produced or into which condensate water flows may be the intake ports, and the specific valve may be an intake valve. When the internal combustion engine includes the EGR device, the production of condensate water or the inflow of condensate water occurs in the intake ports after the stop of the engine. Further, the internal combustion engine may include a compressor and an intercooler in the intake passage. Even in this case, the production of condensate water or the inflow of condensate water occurs in the intake ports after the stop of the engine. Thus, the ports in which condensate water is produced or into which condensate water flows may be the intake ports, and the specific valve may be an intake valve.

The internal combustion engine may include a compressor and an intercooler in the intake passage. The either the intake ports or the exhaust ports may be the intake ports, and the specific valve may be the intake valve. The specific cylinder may be a cylinder in which an intake path from the intercooler to the intake valve is shorter than in the other cylinders. The likelihood of accumulation of condensate water in the cylinder increases as the intake passage from the intercooler to the intake valve shortens. Therefore, by regarding the intake valve in this cylinder as a specific valve, the occurrence of a full-closure malfunction in the valve can be suppressed.

The specific cylinder may be a cylinder in which an intake path from a surge tank to the intake valve is shorter than in the other cylinders, and the specific valve may be the intake valve. The likelihood of accumulation of condensate water in the cylinder increases as the intake passage from the surge tank to the intake valve shortens. Therefore, by regarding the intake valve in this cylinder as a specific valve, the occurrence of a full-closure malfunction in the valve can be suppressed.

The internal combustion engine may be a V-engine that is mounted on a vehicle while being inclined in a rotational direction of a crankshaft. In this case, the specific cylinder may be a cylinder that is provided in that one of two banks constituting the V-engine in which an angle formed by a direction of connection of one of either the intake ports or the exhaust ports to a combustion chamber and a vertical direction is smaller than in the other bank. The likelihood of accumulation of condensate water around the valve after downward fall thereof along the port increases as the direction of connection of the port approaches the vertical direction. Therefore, by regarding such a cylinder as a specific cylinder, the occurrence of a full-closure malfunction in the valve can be suppressed.

In the control apparatus for the internal combustion engine, the electronic control unit may be configured to estimate amounts of condensate water in either the intake ports or the exhaust ports individually for the cylinders when the engine is stopped. The electronic control unit may be configured to determine the specific cylinder based on the amounts of condensate water in the respective cylinders.

In the control apparatus for the internal combustion engine, the electronic control unit may be configured to estimate an amount of condensate water in the entire internal combustion engine as to the either the intake ports or the exhaust ports. The electronic control unit may be configured to perform an operation of making a lift amount of the specific valve equal to zero when the internal combustion engine is stopped, in a case where the estimated amount of condensate water is larger than a predetermined threshold. The electronic control unit may be configured not to perform the operation of making the lift amount of the specific valve equal to zero when the internal combustion engine is stopped, in a case where the estimated amount of condensate water is equal to or smaller than the threshold.

When the lift amount of the specific valve is made equal to zero, the rotational speed of the internal combustion engine is restrained from falling because the pumping loss decreases. As a result, it takes a long time until the internal combustion engine is completely stopped. Accordingly, in the control apparatus for the internal combustion engine, the electronic control unit may be configured to perform the operation of making the lift amount of the specific valve equal to zero when the internal combustion engine is stopped, after a rotational speed of the internal combustion engine becomes equal to or lower than a predetermined rotational speed.

Besides, in the case where the specific valve is an intake valve, when the specific valve first enters a suction stroke in starting the engine next time, initial explosion cannot be carried out due to full-closure of the intake valve, so it takes a long time until the engine is started. Accordingly, in the control apparatus for the internal combustion engine, the electronic control unit may be configured to control a stop crank angle of the internal combustion engine such that one of the cylinders other than the specific cylinder first enters a suction stroke in starting the engine next time, in a case where the specific valve is the intake valve and the operation of making the lift amount of the specific valve equal to zero is performed when the internal combustion engine is stopped.

A second aspect of the disclosure is a control method for an internal combustion engine. The internal combustion engine includes a plurality of cylinders and ports. The ports include intake ports and exhaust ports corresponding to the plurality of the cylinders respectively. The internal combustion engine is an internal combustion engine in which amounts of condensate water produced in the ports or flowing into the ports are different from one another among the cylinders due to differences in shape or arrangement of the ports or conduits leading to the ports among the plurality of the cylinders as to either the intake ports or the exhaust ports. The control method includes performing, by an electronic control unit, an operation of making a lift amount of a specific valve corresponding to one of either the intake ports or the exhaust ports for a specific cylinder when the internal combustion engine is stopped, in a case where the electronic control unit predicts hat condensate water is produced in one of either the intake ports or the exhaust ports or condensate water flows into one of either the intake ports or the exhaust ports. The specific cylinder is a cylinder in which an amount of condensate water produced in one of either the corresponding intake ports or the corresponding exhaust ports or condensate water flowing into one of either the corresponding intake ports or the corresponding exhaust ports is larger than in the other ones of the plurality of the cylinders.

As described above, the control apparatus and control method for the internal combustion engine according to the disclosure can reduce the possibility of the occurrence of a full-closure malfunction in the valve resulting from the freezing of condensate water in the gap between the valve face and the valve seat after the stop of the internal combustion engine.

BRIEF DESCRIPTION OF THE DRAWINGS

Features, advantages, and technical and industrial significance of exemplary embodiments will be described below with reference to the accompanying drawings, in which like numerals denote like elements, and wherein.

FIG. 3 is a chart summarizing an operating condition and external environmental condition on which condensate water is produced in an intake system and an exhaust system;

DETAILED DESCRIPTION OF EMBODIMENTS

The embodiments of the disclosure will be described hereinafter with reference to the drawings. It should be noted, however, that each of the embodiments shown below exemplifies an apparatus and method for embodying the technical concept of the disclosure, and is not intended to limit the structure and arrangement of components, the sequence of processes and the like to those described below, unless otherwise specified. The disclosure is not limited to the embodiments thereof described below, but can be carried out after being modified in various manners within such a range as not to depart from the gist of the disclosure.

Figure 1:
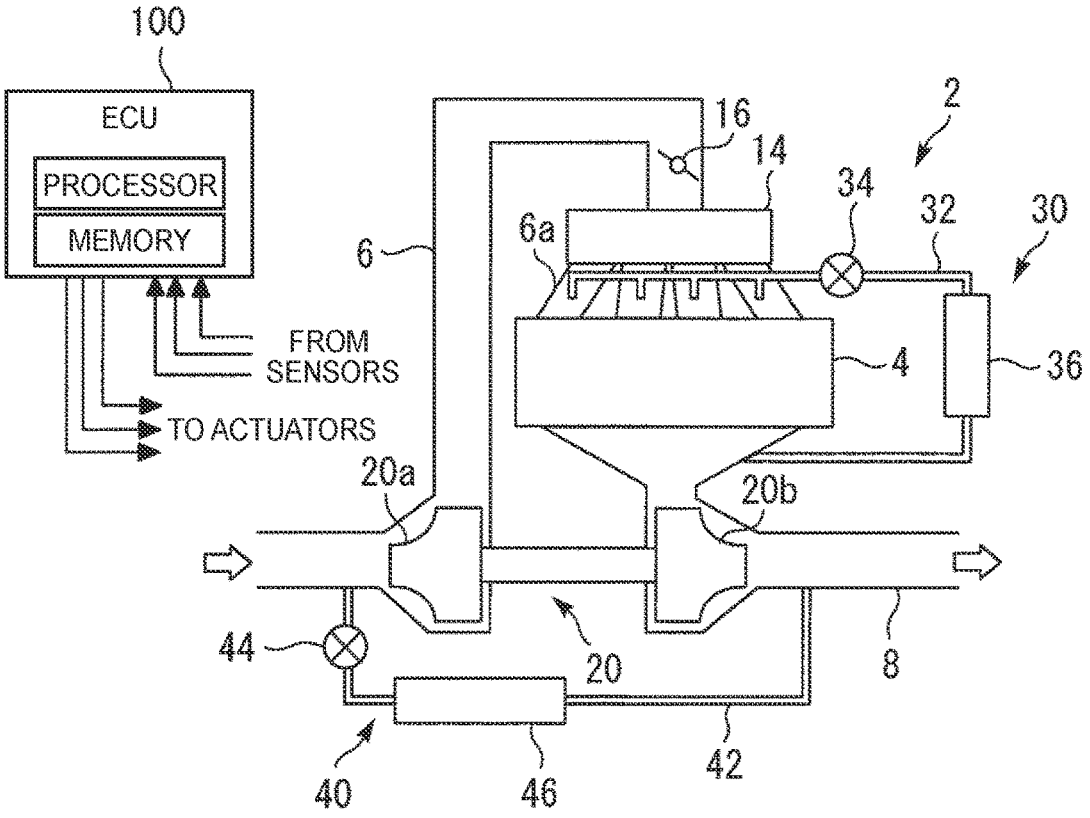
FIG. 1 is a view showing the configuration of an entire system of an internal combustion engine according to one of the embodiments of the disclosure.

FIG. 1 is a view showing the configuration of an entire system of an internal combustion engine 2 according to one of the embodiments. This internal combustion engine 2 is an internal combustion engine (hereinafter referred to simply as an engine) that is mounted on a vehicle. The engine 2 is constituted of an engine body 4, an intake system device including an intake passage 6, an exhaust system device including an exhaust passage 8, and an electronic control unit (ECU) 100. A compressor 20*a*, a throttle 16, and an intercooler 14 are arranged in this order, from an upstream side toward the engine body 4, in the intake passage 6 through which air is introduced into the engine body 4 from the outside. The intercooler 14 is integrated with a surge tank of an intake manifold 6*a*. A turbine 20*b* that is combined with the compressor 20*a* to constitute a turbo supercharger 20 is arranged in the exhaust passage 8 from which exhaust gas is discharged to the outside from the engine body 4.

The internal combustion engine 2 is equipped with two exhaust gas recirculation (EGR) devices 30, 40 that recirculate part of exhaust gas to the intake passage 6 from the exhaust passage 8. One of the EGR devices is the high-pressure-loop (HPL)-EGR device 30, and the other is the low-pressure-loop (LPL)-EGR device 40. The HPL-EGR device 30 is constituted of an EGR passage 32, an EGR cooler 36, and an EGR valve 34. The EGR passage 32 connects the intake passage 6 downstream of the throttle 16, for example, the surge tank or an intake port 58 to the exhaust passage 8 upstream of the turbine 20*b*. The LPL-EGR device 40 is constituted of an EGR passage 42, an EGR cooler 46, and an EGR valve 44. The EGR passage 42 connects the intake passage 6 upstream of the compressor 20*a* to the exhaust passage 8 downstream of the turbine 20*b*.

The electronic control unit 100 has at least one processor and at least one memory. Various data including various programs and maps for controlling the engine 2 are stored in the memory. Various functions are realized in the electronic control unit 100 through the loading of the programs stored in the memory and the execution thereof by the at least one processor. Various pieces of information on an operating state and operating condition of the engine 2 are input to the electronic control unit 100 from various sensors attached to the engine 2 and the vehicle. The electronic control unit 100 determines, based on at least these pieces of information, operation amounts of actuators relevant to the operation of the engine 2. These actuators include a motor (not shown) (e.g., a starting motor or a driving motor for a hybrid vehicle) capable of forcibly rotating the engine body 4. Incidentally, the electronic control unit 100 may be constituted of a plurality of ECU's.

Figure 2:
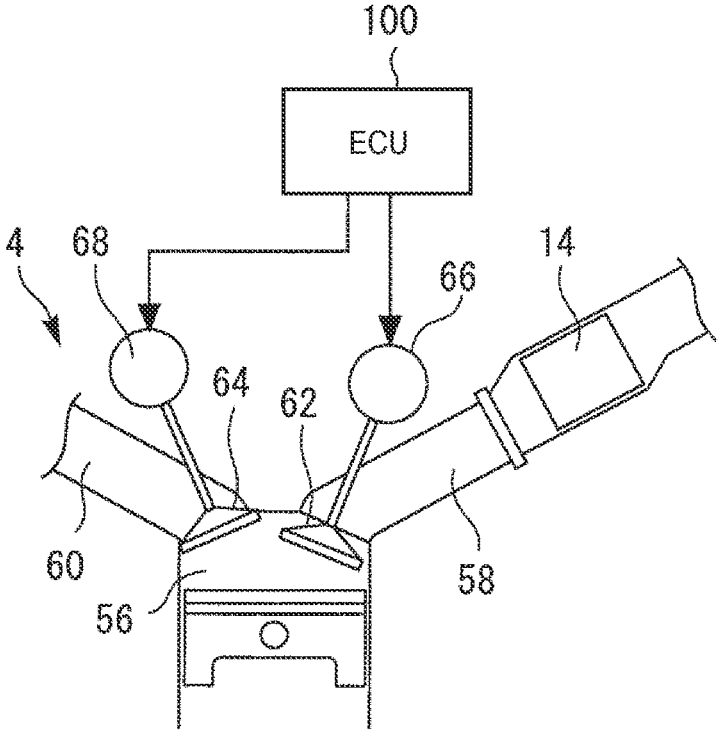
FIG. 2 is a view showing the configuration of an engine body of the internal combustion engine according to one of the embodiments of the disclosure.

FIG. 2 is a view showing the configuration of the engine body 4. The engine body 4 is configured as a multi-cylinder engine that is equipped with a plurality of cylinders, for example, an in-line four-cylinder engine. It should be noted, however, that the engine body 4 may be configured as a spark ignition-type engine or a diesel engine. A cylinder head of the engine body 4 is provided, for each of cylinders, with an intake port 58 and an exhaust port 60, which lead to a combustion chamber 56 of each of the cylinders. A space between the combustion chamber 56 and the intake port 58 is opened/closed by an intake valve 62, and a space between the combustion chamber 56 and the exhaust port 60 is opened/closed by an exhaust valve 64. The intake port 58 and the exhaust port 60 will be hereinafter simply referred to also comprehensively as ports in some cases.

Both a valve mechanism 66 that drives the intake valve 62, and a valve mechanism 68 that drives the exhaust valve 64 are mechanical variable valve mechanisms to which a driving force is distributed from a crankshaft (not shown) of the engine body 4. The variable valve mechanisms 66, 68 are equipped with variable lift mechanisms that make lift amounts of the intake valve 62 and the exhaust valve 64 variable, and can stop the intake valve 62 and the exhaust valve 64 by making the lift amounts thereof equal to zero respectively. Besides, both the intake-side and exhaust-side variable valve mechanisms 66,68 can be independently operated for each of the cylinders. Each of the variable valve mechanisms 66, 68 is one of the actuators that are operated by the electronic control unit 100.

In the engine 2 configured as described above, condensate water flows into the intake port 58 and the exhaust port 60 in some cases. When this condensate water that has flowed into the intake port 58 and the exhaust port 60 reaches the intake valve 62 and the exhaust valve 64 respectively, the condensate water accumulates on a valve head of each valve in its fully-closed state. The condensate water flows down into each of the cylinders from a gap between a valve face and valve seat of each valve with a large opening degree. In some cases, however, the condensate water may remain as drops of water in the gap between the valve face and the valve seat, depending on the amount of condensate water. Besides, the condensate water stays in the gap between the valve face and valve seat of each valve with a small opening degree, instead of flowing down therefrom. The condensate water that has remained around the intake valve 62 and the exhaust valve 64 freezes into ice when the temperature around the intake valve 62 and the exhaust valve 64 falls below zero. The ice into which the condensate water freezes around the intake valve 62 and the exhaust valve 64 influences the startability in restarting the engine 2. For example, when the condensate water freezes between the valve face and the valve seat, a full-closure malfunction, namely, a failure to completely close the intake valve 62 or the exhaust valve 64 occurs.

FIG. 3 shows a result obtained by investigating where and on what conditions the above-mentioned condensate water is produced. FIG. 3 is a chart summarizing an operating condition and external environmental condition on which condensate water is produced, as to each of an intake system and an exhaust system.

The chart shown in FIG. 3 reveals that the intake system has production regions of condensate water that are peculiar to a supercharging LPL system, and production regions of condensate water that are common to the supercharging LPL system and a supercharging HPL system. The supercharging LPL system is a system that is equipped with the compressor and the LPL-EGR device, and EGR gas is introduced upstream of the compressor. The supercharging HPL system is a system that is equipped with the compressor and the HPL-EGR device, and EGR gas is introduced downstream of the compressor, more specifically, into the surge tank or the intake port. Incidentally, even in a naturally aspirated engine that is not equipped with a compressor, EGR is introduced into a surge tank or an intake port. Therefore, the production regions and production condition of condensate water in the naturally aspirated engine may be considered to be the same as those of the supercharging HPL system.

One of the production regions of condensate water in the supercharging LPL system is the intercooler. It should be noted, however, that the intercooler is a water-cooled intercooler, and that the temperature of coolant for the intercooler is assumed to be an outside air temperature+10° C. The engine coolant temperature is irrelevant to the production of condensate water in this region. As for the outside air temperature, when the outside air temperature is low, the temperature of coolant for the intercooler falls, so the production amount of condensate water increases. As for the humidity, when the humidity is high, the production amount of condensate water increases. As for the supercharging pressure, when the supercharging pressure is high, the production amount of condensate water increases. Besides, condensate water is produced when EGR is carried out.

The other production region of condensate water in the supercharging LPL system is a wall surface of an intake duct. The intake duct mentioned herein means the intake passage from the compressor to the intercooler. The engine coolant temperature is also relevant to the production of condensate water in this region. As for the engine coolant temperature, when the engine coolant temperature is low, the production amount of condensate water increases due to a fall in the temperature of the wall surface resulting from heat transfer. As for the outside air temperature, when the outside air temperature is low, the production amount of condensate water increases due to an air-cooling effect. The humidity and the supercharging pressure are the same as those on the production condition of condensate water in the intercooler. Besides, condensate water is produced when EGR is carried out.

One of the production regions of condensate water common to the supercharging LPL system and the supercharging HPL system is an EGR delivery portion, namely, a region where each EGR passage is connected to the intake passage. An operating condition and external environmental condition on which condensate water is produced in this region are the same as the production condition of condensate water on the wall surface of the intake duct of the supercharging LPL system. Besides, condensate water is produced when EGR is carried out.

Another one of the production regions of condensate water common to the supercharging LPL system and the supercharging HPL system is a wall surface of the surge tank. It should be noted, however, that when EGR gas is introduced into the intake port instead of being introduced into the surge tank in the supercharging HPL system, no condensate water is produced in this region. As for the engine coolant temperature, when the engine coolant temperature is low, namely, when the temperature of the wall surface of the surge tank is low, condensate water is produced. The engine coolant temperature at which condensate water is produced is estimated to be about 40° C. This temperature is equivalent to the dew point of the air-fuel mixture whose EGR rate is 30%. The outside air temperature, the humidity and the supercharging pressure are the same as those on the production condition of condensate water on the wall surface of the intake duct of the supercharging LPL system. Besides, condensate water is produced when EGR is carried out.

The other production region of condensate water common to the supercharging LPL system and the supercharging HPL system is the wall surface of the intake port. As for the engine coolant temperature, when the engine coolant temperature is low, namely, when the temperature of the wall surface of the intake port is low, condensate water is produced. The engine coolant temperature at which condensate water is produced is estimated to be about 40° C. The outside air temperature is not very relevant to the production of condensate water in this region. It should be noted, however, that the production amount of condensate water tends to decrease when the outside air temperature is low. The humidity and the supercharging pressure are the same as those on the production condition of condensate water in the supercharging LPL system. Besides, condensate water is produced when EGR is carried out.

As for the exhaust system, the presence/absence of the EGR device, the presence/absence of supercharging, and the like are irrelevant to the system. The production regions of condensate water are wall surfaces of the exhaust port and an exhaust pipe. The temperature of a wall of the exhaust pipe is relevant to the production of condensate water in these regions. When the temperature of the wall of the exhaust pipe is low, condensate water is produced. That is, in the exhaust system, condensate water is likely to be produced at the time of cold start of the engine. The temperature of the wall of the exhaust pipe at which condensate water is produced is estimated to be about 60° C. This temperature is equivalent to the dew point of exhaust gas. The outside air temperature is not very relevant to the production of condensate water in these regions. It should be noted, however, that the production amount of condensate water tends to increase when the outside air temperature is low. Besides, the influence of the humidity on the production of condensate water is small, and the supercharging pressure is irrelevant to the production of condensate water. Whether or not EGR is carried out is also irrelevant to the production of condensate water.

As described above, the amount of condensate water produced in the engine is determined by various operating conditions and external environmental conditions that are relevant to the production regions. Besides, it is apparent that the amount of condensate water flowing to the ports is not homogeneous among the cylinders in the case where attention is focused on the individual cylinders. This has something to do with the difference in the shape or arrangement of the ports and ducts leading to the ports among the cylinders.

Figure 4:
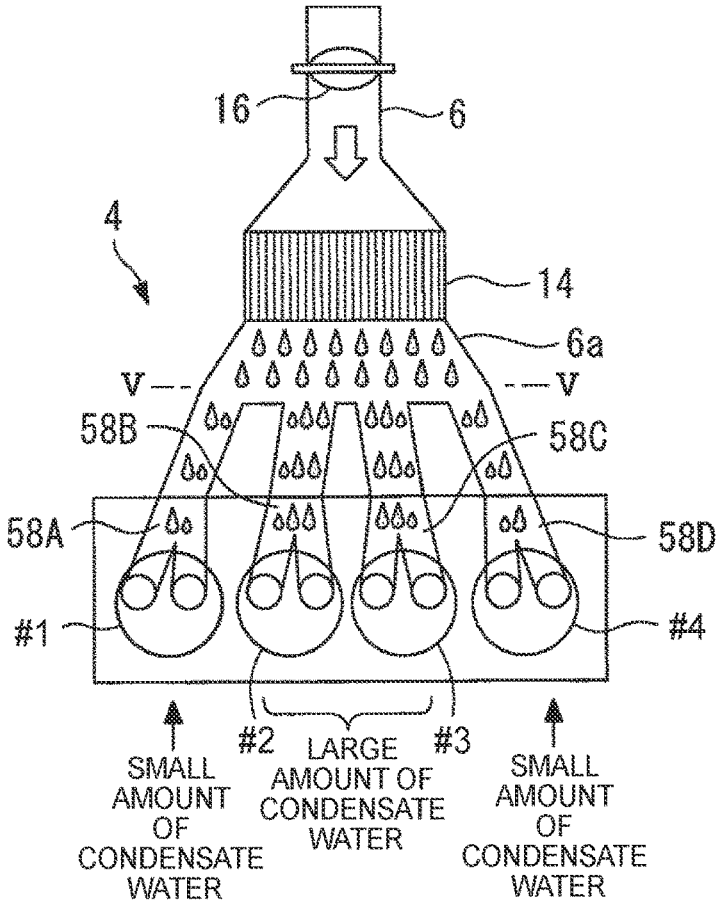
FIG. 4 is a view showing an exemplary relationship between the shape of an intake manifold and the amounts of condensate water flowing to respective cylinders.

FIG. 4 is a view showing an exemplary relationship between the shape of the intake manifold 6*a* leading to the intake ports 58 (58A, 58B, 58C, and 58D) and the amounts of condensate water flowing to the respective cylinders. The intake manifold 6*a* shown in FIG. 4 has a symmetrical shape. An intake path from the intercooler 14 to the first cylinder #1 and an intake path from the intercooler 14 to the fourth cylinder #4 are symmetrical to each other. An intake path from the intercooler 14 to the second cylinder #2 and an intake path from the intercooler 14 to the third cylinder #3 are symmetrical to each other. The distance of the intake paths from the intercooler 14 to the second cylinder #2 and the third cylinder #3 is shorter than the distance of the intake paths from the intercooler 14 to the first cylinder #1 and the fourth cylinder #4. Condensate water is larger in inertial mass than gas and flows along the wall surface. Therefore, the flowability of condensate water increases as the distance from the intercooler 14 shortens. Therefore, in the example shown in FIG. 4, the amounts of condensate water flowing to the intake ports 58B and 58C of the second cylinder #2 and the third cylinder #3 at the center are large, and the amounts of condensate water flowing to the intake ports 58A and 58D of the first cylinder #1 and the fourth cylinder #4 at both ends are small.

Figure 5:
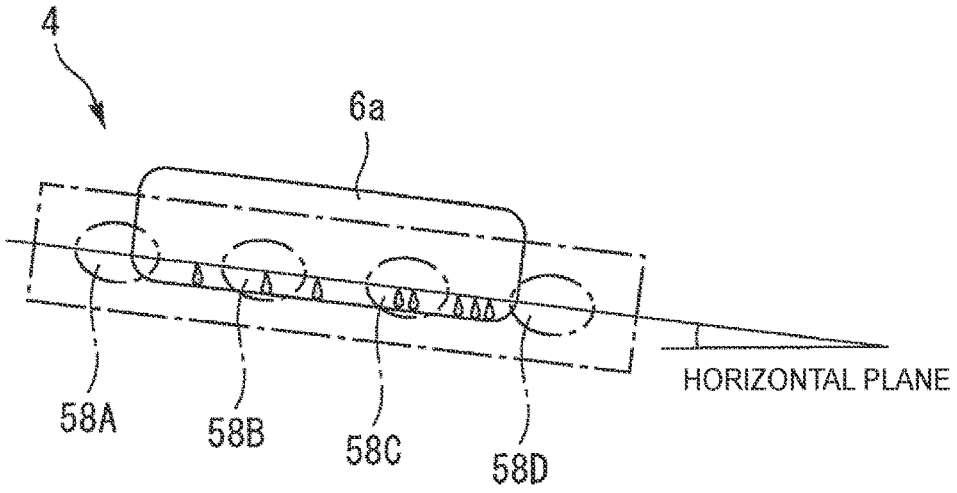
FIG. 5 is a view taken along a line V-V of FIG. 4, and is a view showing a relationship between the gradient of the engine body and the amounts of condensate water flowing to the respective cylinders.

It should be noted, however, that when the engine body 4 is inclined with respect to a horizontal plane as shown in FIG. 5, condensate water is likely to flow toward a low portion of the engine body 4 because there is no gas flow during the stop of the engine. The engine body 4 can be inclined in this manner not only when the engine body 4 is mounted at a certain angle on the vehicle but also when the vehicle is parked on an inclined land. In the example shown in FIG. 5, the engine body 4 is inclined with its right side in the drawing located low. As a result, condensate water is likely to flow toward the right intake ports, and concentrates in the intake port 58C of the third cylinder #3. In the case where the gradient of the engine body 4 is larger, condensate water can concentrate in the intake port 58D of the fourth cylinder #4 at an end portion of the engine body 4.

Figure 6:
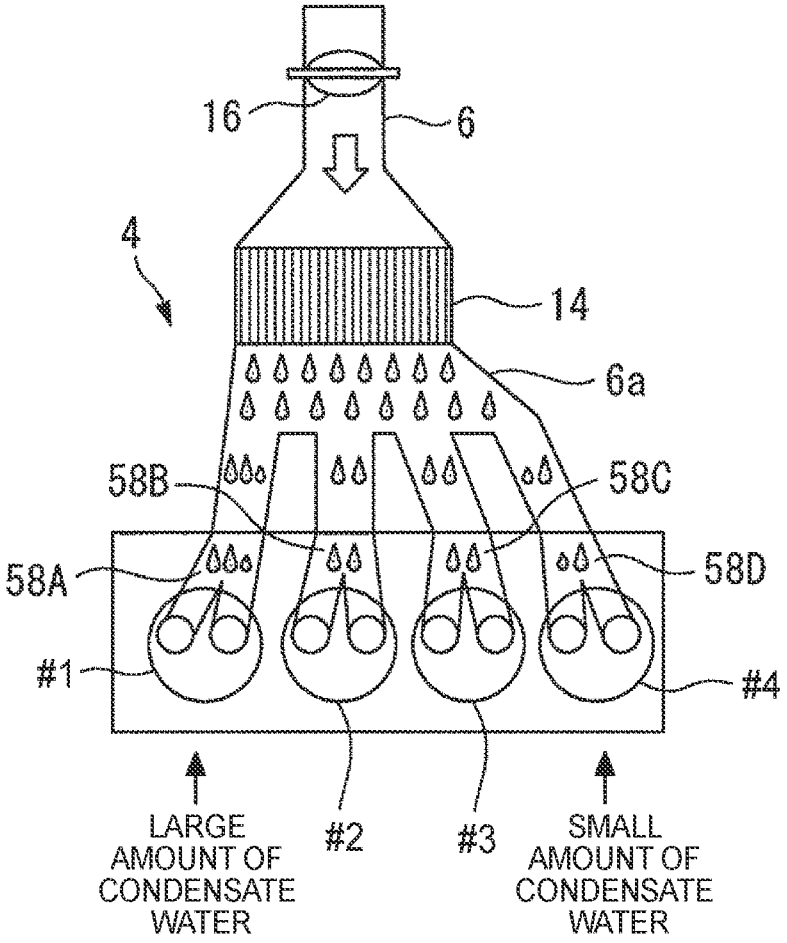
FIG. 6 is a view showing another exemplary relationship between the shape of the intake manifold and the amounts of condensate water flowing to the respective cylinders.

FIG. 6 is a view showing another exemplary relationship between the shape of the intake manifold 6*a* leading to the intake ports 58 (58A, 58B, 58C, and 58D) and the amounts of condensate water flowing to the respective cylinders. The intake manifold 6*a* shown in FIG. 6 assumes such a shape that the position of the intercooler 14 is eccentric toward the left side in the drawing. In the example shown in FIG. 6, the distances of the intake paths from the intercooler 14 to the respective cylinders lengthen in the sequence of the first cylinder #1, the second cylinder #2, the third cylinder #3, and the fourth cylinder #4. Therefore, in the example shown in FIG. 6, the amount of condensate water flowing to the intake port 58A of the first cylinder #1 with the shortest distance of the intake path from the intercooler 14 is the largest, and the amount of condensate water flowing to the intake port 58D of the fourth cylinder #4 with the longest distance of the intake path from the intercooler 14 is the smallest.

As described above, the amount of condensate water produced at the port or flowing into the port differs among the cylinders. Besides, the ranks of the amounts of condensate water among the cylinders may change depending on the condition. Therefore, with a view to taking a measure against the freezing of condensate water, it is desirable to consider that the amount of condensate water differs among the cylinders, and that the differences in the amount of condensate water among the cylinders change depending on the condition.

Figures 7A, 7B:
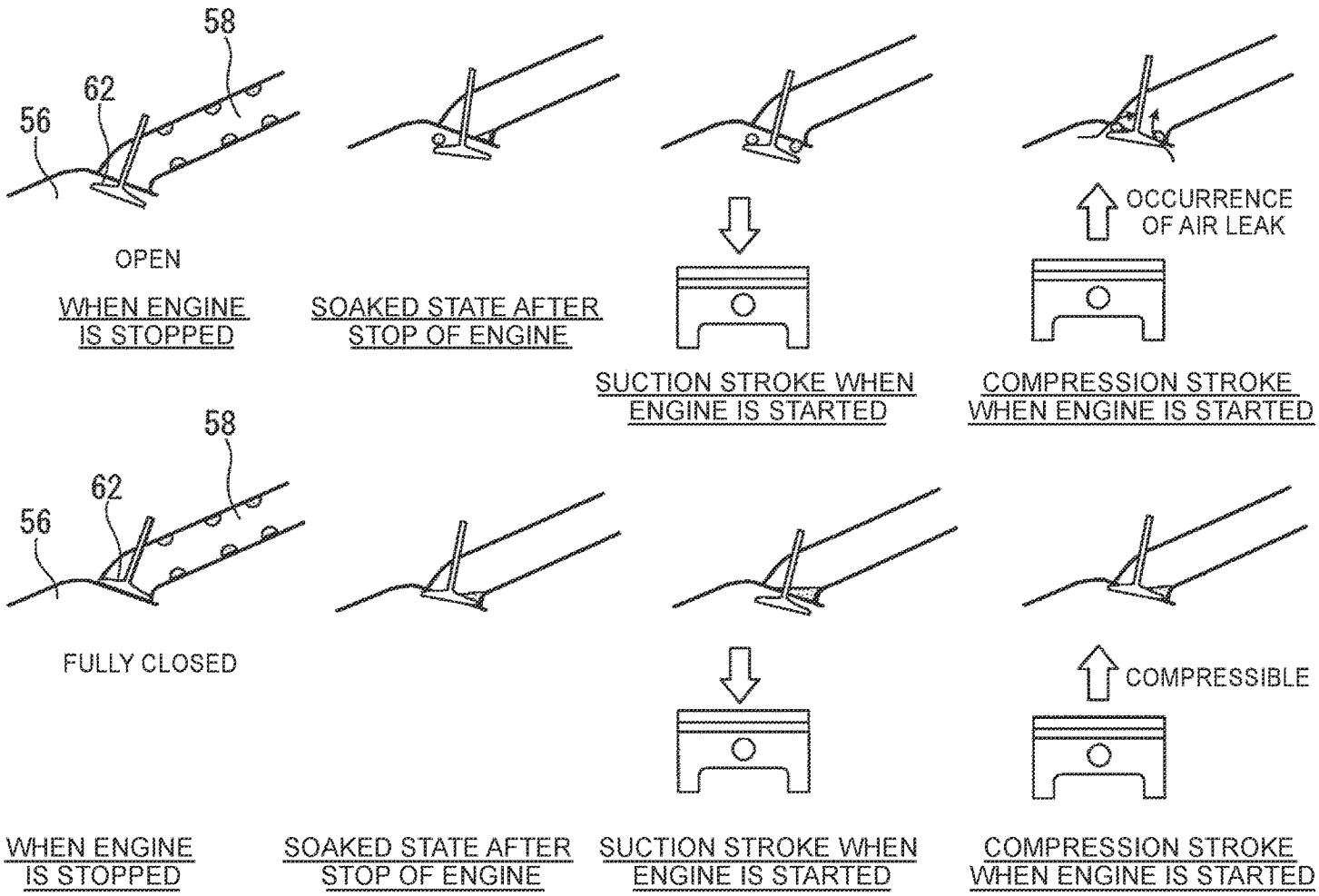
FIG. 7A RELATED ART
FIG. 7B RELATED ART
FIG. 7A is a view illustrating the influence of condensate water that is produced when the disclosure is not applied.
FIG. 7B is a view illustrating the operation of one of the embodiments of the disclosure.

FIG. 7A is a view illustrating the influence of condensate water in an internal combustion engine to which the disclosure is not applied. In the case where the intake valve 62 is open during the stop of the engine, if the outside air temperature has fallen to a degree below freezing when the engine 2 is soaked (the temperature of the engine has fallen to the outside air temperature) after the stop of the engine 2, condensate water freezes in the gap between the valve face and valve seat of the intake valve 62. If the ice into which condensate water has frozen remains when the engine is started, a full-closure malfunction in the intake valve 62 resulting from the jamming by ice occurs, and compressed air leaks, in a compression stroke in which the intake valve 62 that has opened in a suction stroke closes again.

In contrast, FIG. 7B shows the operation in the case where the present embodiment is applied. In the present embodiment, when the engine 2 is stopped, the lift amount of the intake valve 62 is made equal to zero through the operation of the variable valve mechanism 66, and the intake valve 62 is stopped in that state. It should be noted, however, that the operation of fully closing the intake valve 62 is not necessarily performed for all the cylinders. The operation of fully closing the intake valve 62 is performed only for that one of the cylinders (hereinafter referred to as a specific cylinder) in which the amount of condensate water produced in the intake port 58 or flowing into the intake port 58 after the stop of the engine is larger than in the other cylinders. For example, in the example shown in FIG. 4, the second cylinder #2 and the third cylinder #3 may be treated as specific cylinders. In the example shown in FIG. 5, only the third cylinder #3 may be treated as a specific cylinder. In the example shown in FIG. 6, only the first cylinder #1 may be treated as a specific cylinder, or the first cylinder #1 and the second cylinder #2 may be treated as specific cylinders.

According to the measure taken in the present embodiment, condensate water is prevented from freezing in the gap between the valve face and valve seat of the intake valve 62 when the engine 2 is soaked after being stopped, by fully closing and stopping the intake valve 62 in stopping the engine 2. Therefore, the full-closure malfunction in the intake valve 62 resulting from the jamming by ice does not occur when the engine is started. Thus, the air in the cylinders can be normally compressed in the compression stroke.

The above-mentioned measure against the freezing of condensate water is taken in the form of valve stop control by the electronic control unit 100. Valve stop control is a program that is executed on a certain cycle by the electronic control unit 100. The control flow of this program is represented by a flowchart of FIG. 8.

Figure 8:
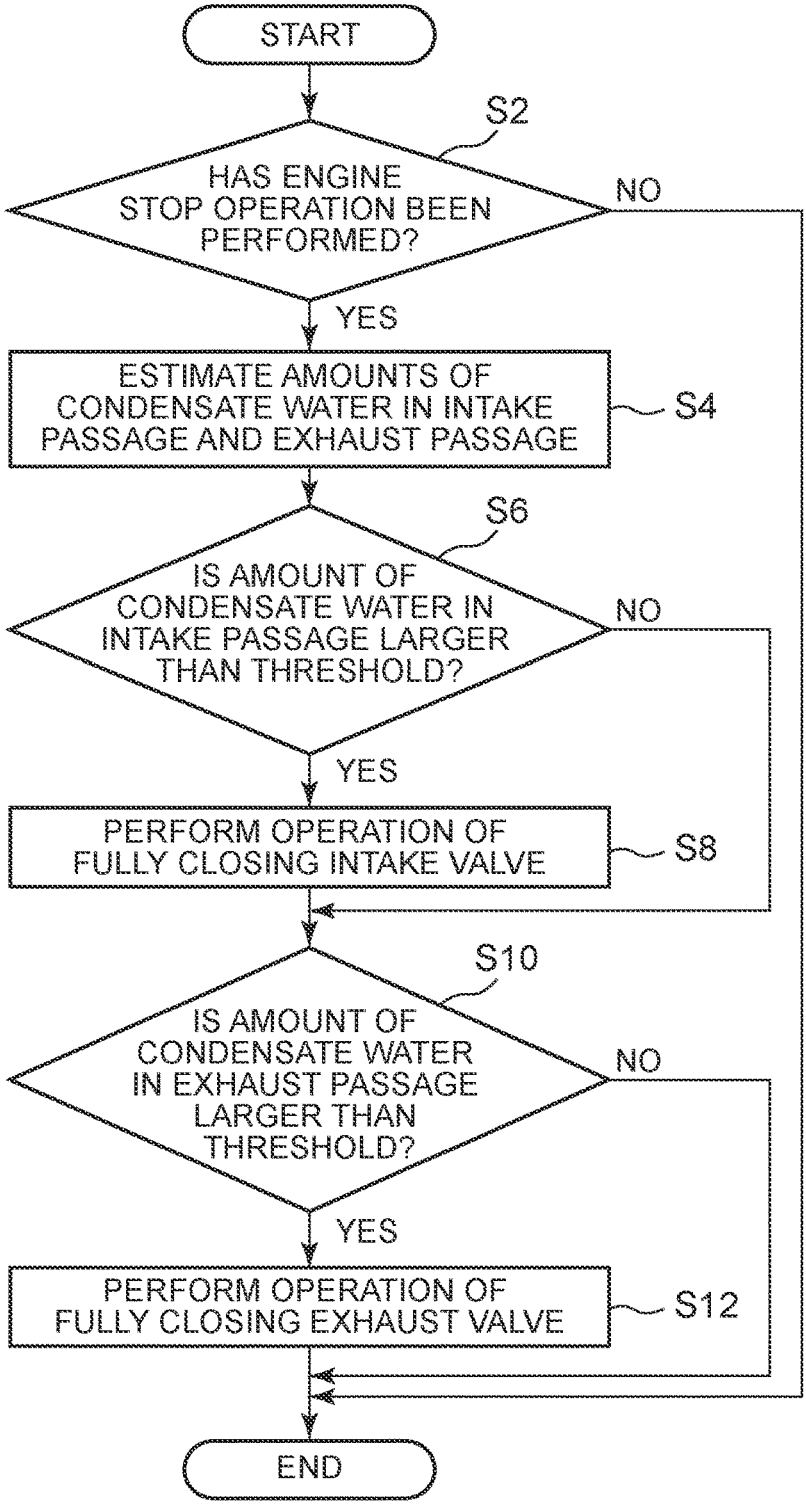
FIG. 8 is a flowchart showing the control flow of valve stop control.

As shown in the flowchart of FIG. 8, valve stop control is constituted of six steps. In step S2, the electronic control unit 100 determines whether or not an engine stop operation has been performed. The engine stop operation includes an operation that is performed by a driver to turn off an ignition switch of the engine 2, and an operation that is performed by the electronic control unit 100 to temporarily stop the engine 2 in an EV mode of the hybrid vehicle. If the engine stop operation has not been performed, there is no need to stop the valves 62 and 64, so the following processes are skipped.

Figure 9:
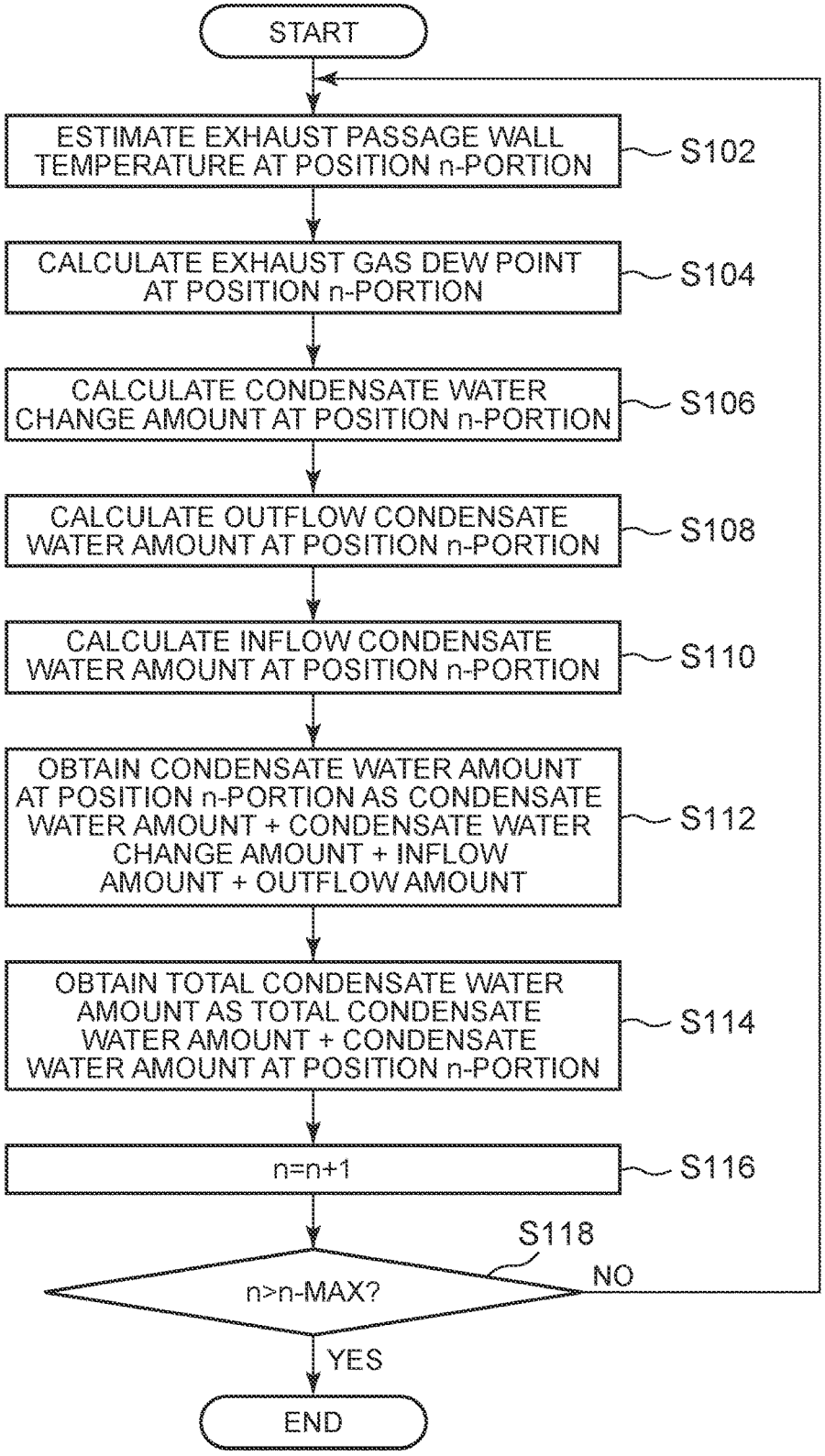
FIG. 9 is a flowchart showing the calculation flow for calculating the amount of condensate water.

In step S4, the electronic control unit 100 estimates an amount of condensate water in the intake system and an amount of condensate water in the exhaust system. In estimating the amount of condensate water in the exhaust system, an exhaust path from the exhaust valve 64 is divided into a plurality of circular rings in the direction opposite to the direction of flow, and a production amount of condensate water is calculated from a temperature of the wall surface and a dew-point temperature of exhaust gas for each of the circular rings. Then, this value is sequentially calculated from a downstream portion of the exhaust port 60 toward the exhaust valve 64. FIG. 9 is a flowchart showing the concrete calculation flow for calculating the amount of condensate water in the exhaust system. In step S4, the electronic control unit 100 calculates the amount of condensate water in the exhaust system according to the calculation flow of FIG. 9.

According to the calculation flow shown in FIG. 9, a temperature of the wall surface at a position-n portion at the time when the exhaust path is divided into (n-MAX) circular rings is estimated (step S102). Besides, a dew-point temperature of exhaust gas at the position-n portion is calculated (step S104). Subsequently, an amount of change of condensate water at the position-n portion is calculated based on the temperature of the wall surface and the dew-point temperature (step S106). Besides, an outflow amount of condensate water flowing out from the position-n portion to an upstream region of the exhaust path is calculated (step S108), and an inflow amount of condensate water flowing from a downstream region of the exhaust path into the position-n portion is calculated (step S110). Then, the amount of condensate water at the position-n portion is updated by adding the amount of change of condensate water, the outflow amount of condensate water, and the inflow amount of condensate water to a last value of the amount of condensate water at the position-n portion (step S112). Subsequently, a total amount of condensate water in the entire exhaust system is updated by adding the amount of condensate water at the position-n portion to the last value of the total amount of condensate water in the entire exhaust system (step S114). After the foregoing processes are ended, the value n is updated (step S116). Then, the processes from step 102 to step S116 are repeatedly executed until the value n exceeds a maximum value n-MAX (step S118).

In estimating the amount of condensate water in the intake system, the intake path to the intake valve 62 is divided into a plurality of circular rings in the direction opposite to the direction of flow, and the production amount of condensate water is calculated from the temperature of the wall surface and the dew-point temperature of intake air for each of the circular rings. Then, this value is sequentially calculated from an upstream portion of the intake port 58 toward the intake valve 62. Specifically, the amount of condensate water in the intake system is calculated according to the calculation flow created in the same way of thinking as the method of calculating the amount of condensate water in the exhaust system.

Returning to FIG. 8 again, the description of valve stop control will be continued. In step S6, the electronic control unit 100 determines whether or not the amount of condensate water in the intake system estimated in step S4 is larger than a threshold. The threshold that is used in the determination of step S6 is an upper limit of the amount of condensate water that allows the intake valve 62 to be kept from being stopped in its fully-closed state. The freezing of condensate water in the gap between the valve face and the valve sheet does not occur when the amount of condensate water is small. Therefore, if the result of the determination in step S6 is negative, namely, if the amount of condensate water is equal to or smaller than the threshold, the operation of stopping the intake valve 62 in its fully-closed state is not performed. Thus, the consumption of energy can be suppressed.

If the result of the determination in step S6 is positive, the electronic control unit 100 performs the control of stopping the intake valve 62 as a specific valve in its fully-closed state in step S8. The stop of the intake valve 62 in its fully-closed state is realized by making the lift amount of the intake valve 62 equal to zero through the operation of the variable valve mechanism 66. The cylinder whose intake valve 62 is stopped in its fully-closed state is required to be that one of the cylinders in which it is determined that the amount of condensate water turns out in advance to be larger than in the other cylinders, namely, the specific cylinder. That is, in the cylinder in which the freezing of condensate water in the gap between the valve face and the valve seat is unlikely to occur due to a small amount of condensate water, the intake valve 62 is not stopped in its fully-closed state. Thus, the probability of the occurrence of circumstances in which the intake valve 62 cannot be opened due to a malfunction in the variable valve mechanism 66 in restarting the engine can be lowered. Incidentally, even in the cylinders other than the specific cylinder, the intake valve 62 accidentally stops in its fully-closed state in some cases due to a relationship with the crank angle at the time of the stop of the engine. As a matter of course, this accidental stop of the intake valve 62 in its fully-closed state is permitted.

In step S10, the electronic control unit 100 determines whether or not the amount of condensate water in the exhaust system estimated in step S4 is larger than a threshold. The threshold that is used in the determination of step S10 is an upper limit of the amount of condensate water that allows the exhaust valve 64 to be kept from being stopped in its fully-closed state. If the result of the determination in step S10 is negative, namely, if the amount of condensate water is equal to or smaller than the threshold, the operation of stopping the exhaust valve 64 in its fully-closed state is not performed. Thus, the consumption of energy can be suppressed.

If the result of the determination in step S10 is positive, the electronic control unit 100 performs the control of stopping the exhaust valve 64 as a specific valve in its fully-closed state in step S12. The stop of the exhaust valve 64 in its fully-closed state is realized by making the lift amount of the exhaust valve 64 equal to zero through the operation of the variable valve mechanism 68. The cylinder in which the exhaust valve 64 is stopped in its fully-closed state is required to be the specific cylinder in which the amount of condensate water turns out in advance to be larger than in the other cylinders. Thus, the probability of the occurrence of circumstances where the exhaust valve 64 cannot be opened due to a malfunction in the variable valve mechanism 68 in restarting the engine can be lowered. Incidentally, even in the cylinders other than the specific cylinder, the exhaust valve 64 accidentally stops in its fully-closed state in some cases due to a relationship with the crank angle at the time of the stop of the engine. As a matter of course, this accidental stop of the exhaust valve 64 in its fully-closed state is permitted.

Figure 10:
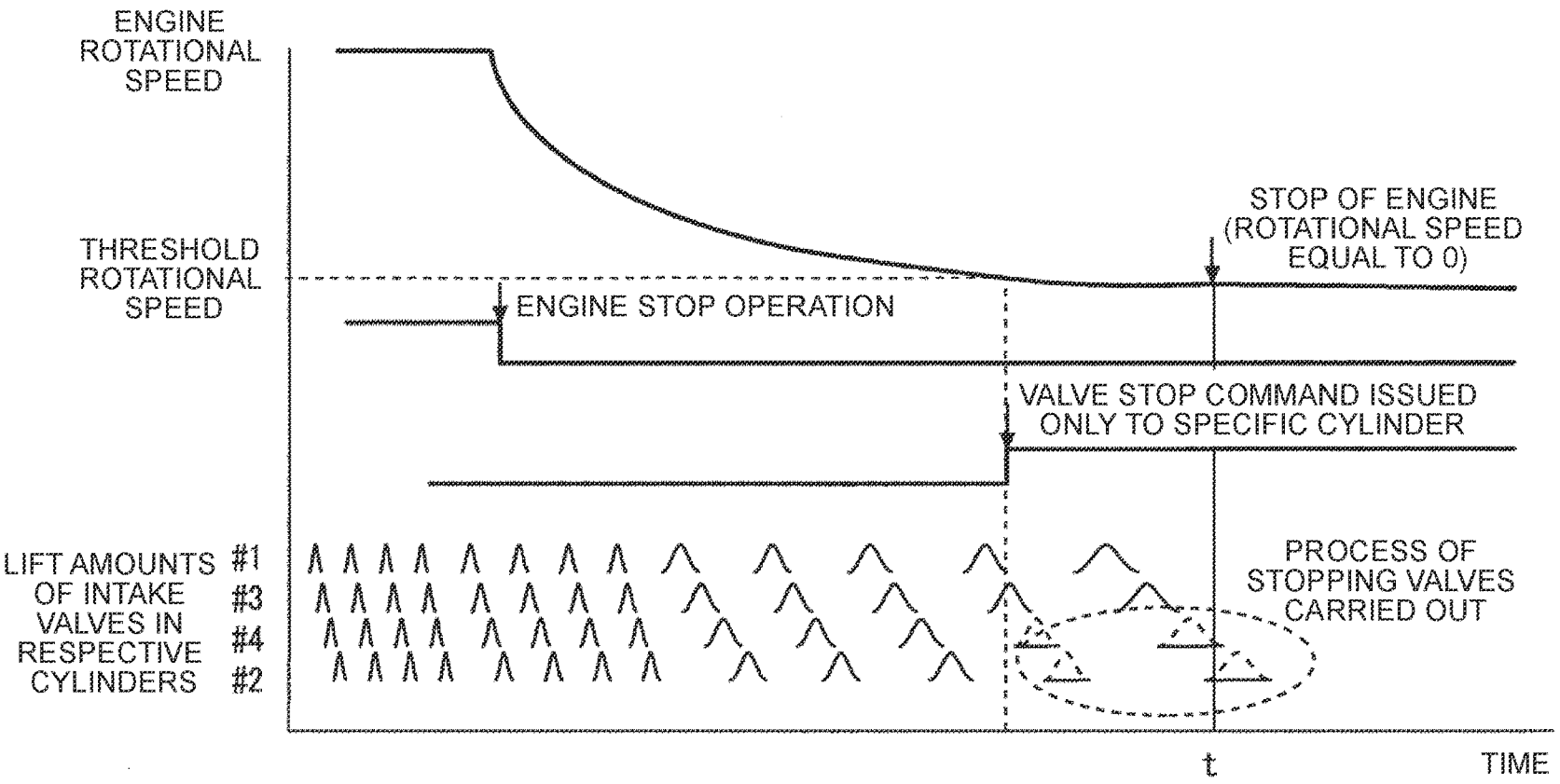
FIG. 10 is a view showing timings for starting the process of stopping valves.

Next, the timing for starting valve stop through valve stop control will be described. FIG. 10 is a view showing the timing for starting valve stop after the operation of stopping the engine. When the lift amount of the intake valve 62 or the exhaust valve 64 is made equal to zero through valve stop control, the rotational speed of the engine is restrained from falling, due to a decrease in pumping loss, and it takes a long time until the engine 2 is completely stopped. Therefore, the operations of the variable valve mechanisms 66 and 68 for valve stop are started not immediately after the operation of stopping the engine, but after the rotational speed of the engine becomes equal to or lower than a threshold rotational speed.

In the example shown in FIG. 10, each of the second cylinder #2 and the fourth cylinder #4 is the specific cylinder in which the intake valve 62 is stopped in its fully-closed state. In this example, the second cylinder #2 and the fourth cylinder #4 are in a suction stroke at the time point when the engine 2 is stopped. In each of these cylinders, the intake valve 62 is fully closed with the lift amount thereof made equal to zero. Therefore, when the engine 2 is in its soaked state after being stopped, condensate water is prevented from freezing in the gap between the valve face and valve seat of the intake valve 62. Incidentally, in this example, although the intake valve 62 in each of the first cylinder #1 and the third cylinder #3 that are not the specific cylinders is also fully closed at the time point when the engine 2 is stopped, this is a coincidence resulting from a relationship with a stop crank angle.

In the case where the lift amount of the intake valve 62 is made equal to zero only in each of the specific cylinders as in the present embodiment, there is also an advantage in that the time for restarting the engine 2 can be made shorter than in the case where the lift amount of the intake valve 62 is made equal to zero as to all the cylinders. This will be described using FIG. 11.

Figure 11A:
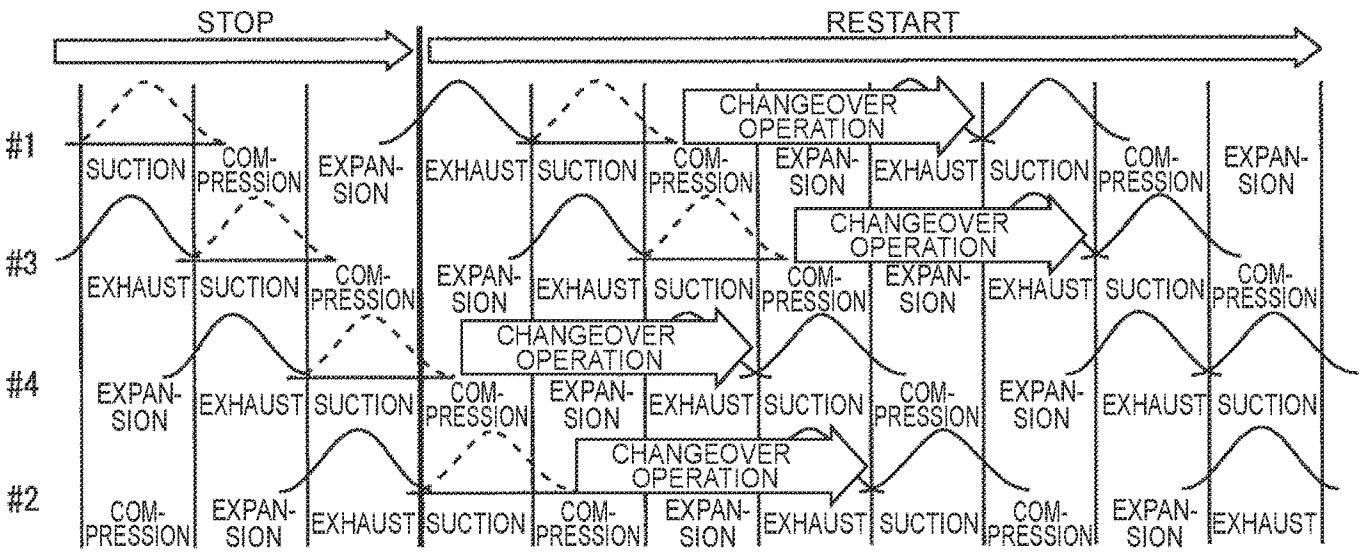
FIG. 11A is a view showing the operation at the time of restart in the case where the valves in all the cylinders are stopped.
Figure 11B:
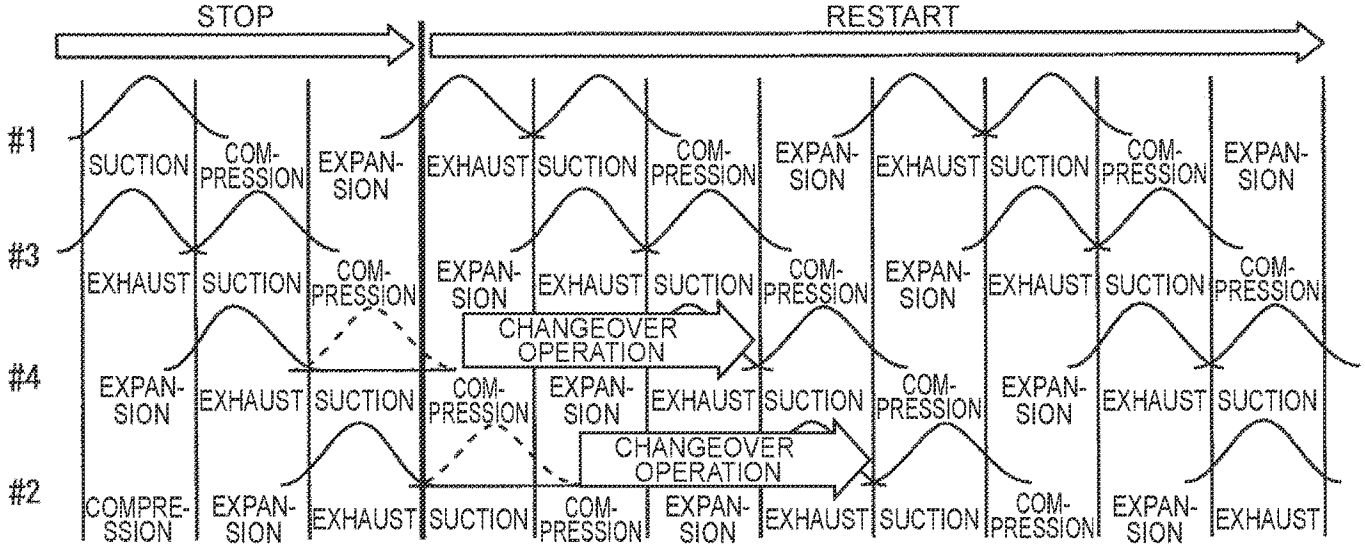
FIG. 11B is a view showing the operation at the time of restart in the case where only the valves in a required one or required ones of the cylinders are stopped.

FIG. 11A is a view showing the operation in restarting the engine in the case where the lift amount of the intake valve 62 is made equal to zero as to all the cylinders #1 to #4 when the engine is stopped. FIG. 11B is a view showing the operation in restarting the engine in the case where the lift amount of only the intake valve 62 in each of the specific cylinders #2 and #4 is made equal to zero when the engine is stopped. In the case where the lift amount of the intake valve 62 is made equal to zero by operating the variable valve mechanism 66, a changeover period of at least one cycle is needed for each of the cylinders in order to return the lift amount of the intake valve 62 to its original value by operating the variable valve mechanism 66 again. As is apparent from a comparison between FIG. 11A and FIG. 11B, only the intake valve 62 in each of the specific cylinders #2 and #4 is stopped in its fully-closed state when the engine is stopped. Thus, the time needed to restart the engine 2 can be shortened.

By the way, in the case where the specific valve is the intake valve 62, when the specific cylinder first enters a suction stroke in restarting the engine, initial explosion cannot be carried out because the intake valve 62 is fully closed. Therefore, initial explosion is awaited until another one of the cylinders subsequently enters a suction stroke, so it takes a long time to start the engine. Therefore, in making the lift amount of the intake valve 62 as the specific valve equal to zero, the electronic control unit 100 controls the stop crank angle of the engine 2 such that one of the cylinders other than the specific cylinder first enters a suction stroke in starting the engine next time. More specifically, the electronic control unit 100 controls the stop crank angle of the engine 2 by, for example, stop position control means such as a starting motor, a motor for driving a hybrid vehicle, or the like, such that the engine 2 is stopped immediately before the intake valve 62 in the cylinder that enters the suction stroke subsequently to the specific cylinder is lifted.

Figure 12:
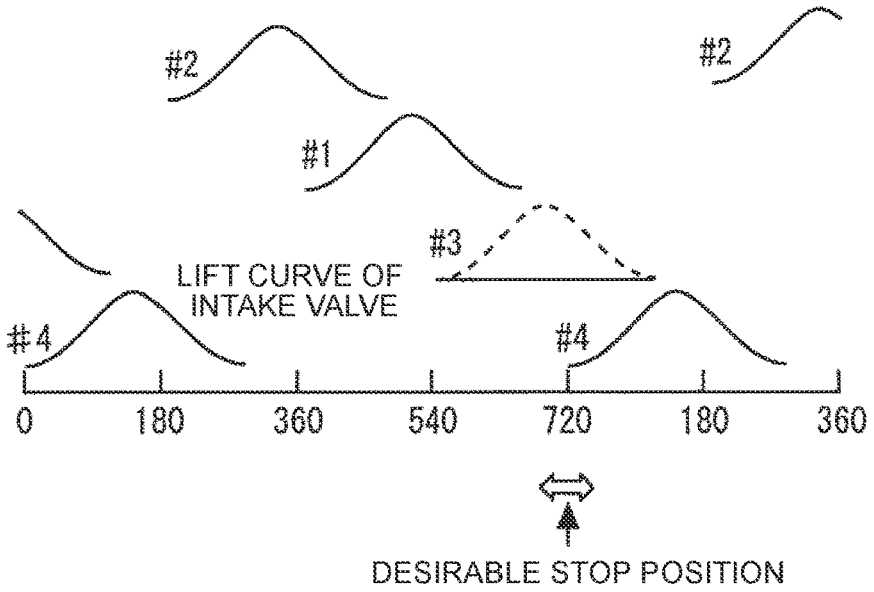
FIG. 12 is a view showing a stop crank angle of the internal combustion engine in the case where valve stop control is performed.

FIG. 12 is a view showing an example of the stop crank angle of the engine 2 in the case where valve stop control is performed. In this example, the third cylinder #3 is a specific cylinder, and the engine 2 is stopped at a crank angle at which the third cylinder #3 enters a suction stroke. Specifically, the engine 2 is stopped immediately before the intake valve 62 in the fourth cylinder #4 that enters the suction stroke subsequently to the third cylinder #3 is lifted. When the stop crank angle of the engine 2 is offset toward a retardation side from this desirable stop position, the intake valve 62 in the fourth cylinder #4 opens, so the cylinder in which initial explosion is carried out shifts to the second cylinder #2, and the time for restarting the engine is extended by a rotational angle of 180°. On the contrary, when the stop crank angle of the engine 2 is offset toward an advancement side from this desirable stop position, a rotational angle to the opening of the intake valve 62 in the fourth cylinder #4 is needed in accordance with the amount of offset, so the time for restarting the engine is extended all the same. Therefore, the range from the crank angle at which the intake valve 62 in the fourth cylinder #4 starts being lifted to the advancement side by a predetermined angle (e.g., 30°) is a desirable stop position as a crank angle at which the engine 2 is stopped.

Figure 13:
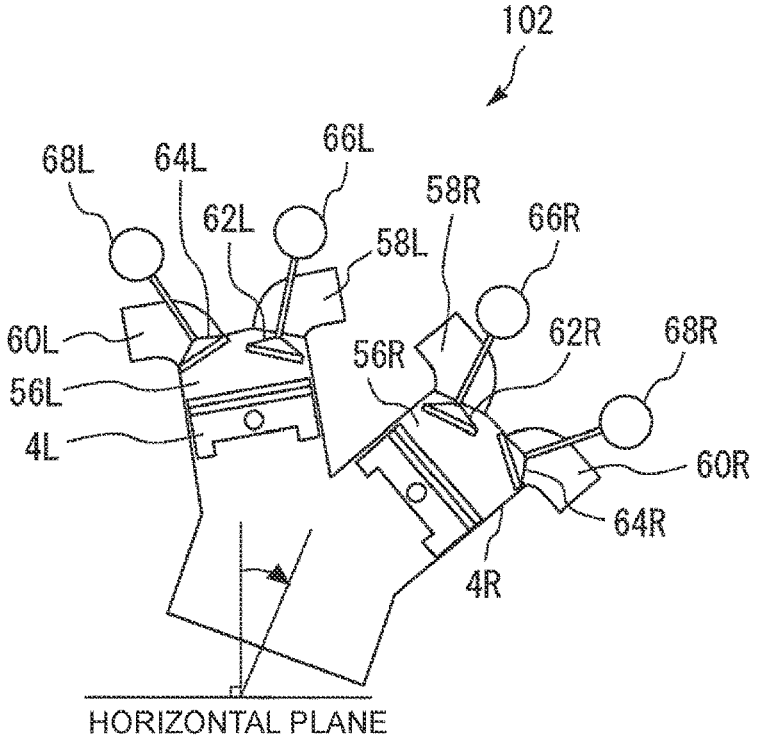
FIG. 13 is a view showing the configuration of a V-engine that is transversely mounted on an FF vehicle.

Next, the other embodiments will be described. The disclosure is also applicable to a V-engine that is transversely mounted on an FF vehicle. An engine 102 shown in FIG. 13 is transversely mounted on a front portion of the vehicle while being inclined in a rotational direction of the crankshaft. The engine 102 has two banks 4R and 4L. The right bank 4R is located on a front side of the vehicle, and the left bank 4L is located on a rear side of the vehicle. The bank angle between the right bank 4R and the left bank 4L is equal to 60°.

Each of cylinder heads of the banks 4R and 4L is provided, for each of cylinders, with each of intake ports 58R and 58L and each of exhaust ports 60R and 60L, which lead to each of combustion chambers 56R and 56L in each of the cylinders. In each of the banks 4R and 4L, each of the intake ports 58R and 58L is provided inside the engine 102, and each of the exhaust ports 60R and 60L is provided outside the engine 102. A space between each of the combustion chambers 56R and 56L and each of the intake ports 58R and 58L is opened/closed by each of intake valves 62R and 62L. A space between each of the combustion chambers 56R and 56L and each of the exhaust ports 60R and 60L is opened/closed by each of exhaust valves 64R and 64L. The intake valves 62R and 62L and the exhaust valves 64R and 64L are all driven by mechanical variable valve mechanisms 66R, 66L, 68R, and 68L respectively.

In the case of a V-engine that is mounted at a certain angle, while condensate water is likely to accumulate around a valve after flowing down through a port in one bank of the engine, there is no such likelihood in the other bank of the engine. The likelihood of the flow of condensate water is determined by an angle that is formed by a direction in which the port is connected to a combustion chamber and a vertical direction. As this angle decreases, the likelihood of flow of condensate water through the port increases, and the likelihood of accumulation of condensate water around the valve increases. In the example shown in FIG. 13, in an intake system, the intake port 58R in the right bank 4R is more vertically erected than the intake port 58L in the left bank 4L, so condensate water is more likely to accumulate around the intake valve 62R in the right bank 4R. On the other hand, in an exhaust system, the exhaust port 60L in the left bank 4L is more vertically erected than the exhaust port 60R in the right bank 4R, so condensate water is more likely to accumulate around the exhaust valve 64L of the left bank 4L.

In the case where there is thus a difference in the likelihood of accumulation of condensate water between the banks, the cylinder that is provided in the bank in which condensate water is likely to accumulate around the valve is regarded as a specific cylinder. That is, in the case where the intake valve is a specific valve, one of the cylinders in the right bank 4R is regarded as a specific cylinder. When the engine is stopped, the intake valve 62R in that cylinder in the right bank 4R is stopped in its fully-closed state. Besides, in the case where the exhaust valve is a specific valve, one of the cylinders in the left bank 4L is regarded as a specific cylinder. When the engine is stopped, the exhaust valve 64L in that cylinder in the left bank 4L is stopped in its fully-closed state. By regarding that one of the cylinders in which condensate water is likely to accumulate around the valve as a specific cylinder, the occurrence of a full-closure malfunction in the valve can be suppressed.

Incidentally, in the above-mentioned embodiment, the variable valve mechanism is mechanically operated, but may be electrically operated. The electrically operated variable valve mechanism that directly drives the valves by an electromagnetic coil or a motor can perform the operation of opening/closing the valves in an operation of preventing freezing without rotating the engine.

Besides, in the above-mentioned embodiment, the cylinders that are regarded as specific cylinders are fixed in advance. However, the specific cylinder or specific cylinders may be determined again every time the engine is stopped. For example, the amount of condensate water in the intake port or the exhaust port may be estimated for each of the cylinders, and the cylinder in which the amount of condensate water is larger than in the other cylinders may be determined as a specific cylinder. Besides, the cylinder having a port with the largest amount of condensate water in both the intake system and the exhaust system may be determined as a specific cylinder, and the valve corresponding to the port may be determined as a specific valve.

What is claimed is:

1. A control apparatus for an internal combustion engine, the internal combustion engine including a plurality of cylinders and ports, the ports including intake ports and exhaust ports corresponding to the plurality of the cylinders respectively, and the internal combustion engine being an internal combustion engine in which amounts of condensate water produced in the ports or flowing into the ports are different from one another among the cylinders due to differences in shape or arrangement of the ports or conduits leading to the ports among the plurality of the cylinders as to either the intake ports or the exhaust ports, the control apparatus comprising an electronic control unit configured to perform an operation of making a lift amount of a specific valve corresponding to one of either the intake ports or the exhaust ports equal to zero for a specific cylinder when the internal combustion engine is stopped, in a case where the electronic control unit predicts that condensate water is produced in one of either the intake ports or the exhaust ports or condensate water flows into one of either the intake ports or the exhaust ports, and the specific cylinder being a cylinder in which an amount of condensate water produced in one of either the corresponding intake ports or the corresponding exhaust ports or condensate water flowing into one of either the corresponding intake ports or the corresponding exhaust ports is larger than in the other ones of the plurality of the cylinders.

2. The control apparatus for the internal combustion engine according to claim 1, wherein the internal combustion engine includes an exhaust gas recirculation device that recirculates part of exhaust gas to an intake passage, the ports in which condensate water is produced or into which condensate water flows are the intake ports, and the specific valve is an intake valve.

3. The control apparatus for the internal combustion engine according to claim 1, wherein the internal combustion engine includes a compressor and an intercooler in the intake passage, the ports in which condensate water is produced or into which condensate water flows are the intake ports, and the specific valve is the intake valve.

4. The control apparatus for the internal combustion engine according to claim 3, wherein the specific cylinder is a cylinder in which an intake path from the intercooler to the intake valve is shorter than in the other cylinders.

5. The control apparatus for the internal combustion engine according to claim 1, wherein the specific cylinder is a cylinder in which an intake path from a surge tank to an intake valve is shorter in the other cylinders, and the specific valve is the intake valve.

6. The control apparatus for the internal combustion engine according to claim 1, wherein the internal combustion engine is a V-engine that is mounted on a vehicle while being inclined in a rotational direction of a crankshaft, and the specific cylinder is a cylinder that is provided in that one of two banks constituting the V-engine in which an angle formed by a direction of connection of one of either the intake ports and the exhaust ports to a combustion chamber and a vertical direction is smaller than in the other bank.

7. The control apparatus for the internal combustion engine according to claim 1, wherein the electronic control unit is configured to estimate amounts of condensate water in either the intake ports or the exhaust ports individually for the cylinders when the engine is stopped, and the electronic control unit is configured to determine the specific cylinder based on amounts of condensate water in the respective cylinders.

8. The control apparatus for the internal combustion engine according to claim 1, wherein the electronic control unit is configured to estimate an amount of condensate water in the entire internal combustion engine as to the either the intake ports or the exhaust ports, the electronic control unit is configured to perform the operation of making a lift amount of the specific valve equal to zero when the internal combustion engine is stopped, in a case where the estimated amount of condensate water is larger than a predetermined threshold, and the electronic control unit is configured not to perform the operation of making the lift amount of the specific valve equal to zero when the internal combustion engine is stopped, in a case where the estimated amount of condensate water is equal to or smaller than the threshold.

9. The control apparatus for the internal combustion engine according to claim 1, wherein the electronic control unit is configured to perform the operation of making the lift amount of the specific valve equal to zero when the internal combustion engine is stopped, after a rotational speed of the internal combustion engine becomes equal to or lower than a predetermined rotational speed.

10. The control apparatus for the internal combustion engine according to claim 1, wherein the electronic control unit is configured to control a stop crank angle of the internal combustion engine such that one of the cylinders other than the specific cylinder first enters a suction stroke in starting the engine next time, when the specific valve is the intake valve and the operation of making the lift amount of the specific valve equal to zero is performed when the internal combustion engine is stopped.

11. A control method for an internal combustion engine, the internal combustion engine including a plurality of cylinders and ports, the ports including intake ports and exhaust ports corresponding to the plurality of the cylinders respectively, and the internal combustion engine being an internal combustion engine in which amounts of condensate water produced in the ports or flowing into the ports are different from one another among the cylinders due to differences in shape or arrangement of the ports or conduits leading to the ports among the plurality of the cylinders as to either the intake ports or the exhaust ports, the control method comprising:

performing, by an electronic control unit, an operation of making a lift amount of a specific valve corresponding to one of either the intake ports or the exhaust ports for a specific cylinder when the internal combustion engine is stopped, in a case where the electronic control unit predicts that condensate water is produced in one of either the intake ports or the exhaust ports or condensate water flows into one of either the intake ports or the exhaust ports, and the specific cylinder being a cylinder in which an amount of condensate water produced in one of either the corresponding intake ports or the corresponding exhaust ports or condensate water flowing into one of either the corresponding intake ports or the corresponding exhaust ports is larger than in the other ones of the plurality of the cylinders.

* * * * *